US011673236B2

(12) United States Patent
Negron

(10) Patent No.: US 11,673,236 B2
(45) Date of Patent: Jun. 13, 2023

(54) WRENCH COMBINATION DEVICE WITH EMBEDDED MAGNETS

(71) Applicant: Javier Negron, Bronx, NY (US)

(72) Inventor: Javier Negron, Bronx, NY (US)

( * ) Notice: Subject to any disclaimer, the term of this patent is extended or adjusted under 35 U.S.C. 154(b) by 341 days.

(21) Appl. No.: 17/019,571

(22) Filed: Sep. 14, 2020

(65) Prior Publication Data

US 2022/0080559 A1 Mar. 17, 2022

(51) Int. Cl.
*B25B 13/08* (2006.01)
*B25B 23/12* (2006.01)

(52) U.S. Cl.
CPC ..... *B25B 13/08* (2013.01); *B25B 23/12* (2013.01)

(58) Field of Classification Search
CPC ..... B25B 13/06; B25B 13/08; B25B 13/48; B25B 23/12
See application file for complete search history.

(56) References Cited

U.S. PATENT DOCUMENTS 1,442,184 A 1/1923 Smith
2,834,237 A 5/1958 Renoux
3,121,356 A * 2/1964 Davis ..... B25B 13/08 81/125.1
6,662,688 B1 12/2003 Avery
6,692,178 B2 2/2004 Yu
6,941,842 B1 9/2005 Liou
7,228,766 B1 6/2007 Shyu
9,272,402 B2 3/2016 Hu
9,676,083 B2 6/2017 Johnson et al.
9,862,080 B2 * 1/2018 Cheng ..... B25B 23/1427
2004/0040421 A1 * 3/2004 Prax ..... B25B 13/08 81/121.1
2010/0282029 A1 * 11/2010 Hsieh ..... B25B 13/06 81/121.1
2011/0146462 A1 6/2011 Watts et al.
2013/0213191 A1 * 8/2013 Harvey ..... B25B 13/08 81/125
2015/0343627 A1 12/2015 Hensley
2019/0076995 A1 3/2019 Albertson

* cited by examiner

*Primary Examiner* — David B. Thomas
(74) *Attorney, Agent, or Firm* — MG Miller Intellectual Property Law LLC

(57) ABSTRACT

A wrench combination device includes three open-jawed wrench sockets. A first open jawed wrench socket is at one end of the device, and a second open jawed wrench socket, which is substantially identical to the first, is at an extreme opposite end. A third open jawed wrench socket is centered between and is inline with the first and second open-jawed wrench sockets, and has two portals. The first portal is open at two opposite ends and extends normal to a plane passing through the first and second open jawed wrench sockets. The second portal opens on one side of the third socket and extends in the plane passing through the first and second open jawed wrench sockets.

6 Claims, 6 Drawing Sheets

WRENCH COMBINATION DEVICE WITH EMBEDDED MAGNETS

FIELD OF THE DISCLOSED TECHNOLOGY

The disclosed technology relates generally to wrenches, and more specifically to wrench combination devices with embedded magnets.

BACKGROUND

In construction work, there often arises a need to screw a nut onto a threaded rod. This situation often requires the use of a wrench. The use of a wrench, however, is made difficult by such factors as the need to continuously remove and reposition the wrench, or even by an especially long rod. Additionally, depending on how a worker is standing, the wrench can easily slip from its position, lengthening the screwing process.

Thus, there is a need for a wrench which can be used to screw a nut along a threaded rod quickly and efficiently, as well as for a wrench which will maintain its position around a nut. These and other problems are solved by embodiments of the disclosed technology, as described below.

SUMMARY OF THE DISCLOSED TECHNOLOGY

A wrench combination device of embodiments of the disclosed technology has a first open-jawed wrench socket at a first end of the device. A second open-jawed wrench socket, which is substantially identical to the first open jawed wrench socket, is disposed at a second end of the device, the second end being at an extreme opposite end relative to the first end. A third open jawed wrench socket is centered between and inline with the first and second open jawed wrench sockets, and has two portals. A first portal is open at two opposite ends and extends normal to a plane passing through the first and second open jawed wrench sockets. A second portal is open on a single side of the third open-jawed wrench socket and in the plane passing through the first and second open-jawed wrench sockets.

"Centered between and inline with" two objects is defined as "spaced substantially equidistantly from, and on a line which passes through," the two objects. "Open at two opposite ends" is defined as "having one opening on a top side of the wrench combination device and one opening on a bottom side of the device, every point of the opening on the top side being substantially vertically inline with a point of the opening on the bottom side". "A plane passing through the first and second open jawed wrench sockets" is defined as "a plane which passes through the first and second open jawed wrench sockets and/or a plane which is substantially parallel to a top and/or bottom side of the wrench combination device".

The present wrench provides safety over the prior art because the wrench magnetically and/or fricationally is held in place relative to a threaded vertical rod.

In some embodiments, the first portal of the third open-jawed wrench socket is enclosed on a majority of sides by a plurality of sides. In embodiments, each side of the plurality of sides is substantially flat and has an equal obtuse or acute angle to at least one adjacent side. The second portal, in various embodiments, has a length equal to each side of the plurality of sides of the third open jawed wrench socket. Each side of the plurality of sides of the third open jawed wrench socket is, in embodiments of the disclosed technology, substantially identical. In some embodiments, a shape formed by a combination of the second portal and the plurality of sides of the third open-jawed wrench socket forms a regular polygon shape.

A "regular polygon shape" is defined as "a partial or complete shape in which all sides are substantially the same size and all angles are substantially the same number of degrees".

The length of the second portal is smaller, in various embodiments, than a horizontally-oriented length between two parallel sides of the plurality of sides of the third open-jawed wrench socket.

"Horizontally-oriented length" is defined as "a length which stretches in a substantially-flat horizontal plane and/or in a plane which is substantially parallel to a top and/or bottom side of the wrench combination device".

At least two sides of the plurality of sides of the third open-jawed wrench socket have embedded therein, in embodiments of the disclosed technology, a magnet, wherein every horizontally-oriented plane passing through one of the at least two magnets also passes through each other magnet of the at least two magnets. In other embodiments, each side of the plurality of sides of the third open jawed wrench socket has embedded therein a magnet, wherein each the magnet, excepting for those closest to the spaced apart region, is at a substantially identical angle to each adjacent magnet.

In embodiments, each side of the plurality of sides of the third open jawed wrench socket has a magnetic embedded therein, and each magnet applies a strongest magnetic force on a most adjacent side relative to that respective magnet. Furthermore, in some embodiments, each side of the plurality of sides of the third open jawed wrench socket has a substantially identical magnetic force applied thereto by each respective magnet.

"Most adjacent side" is defined as a side of the plurality of sides which is closest to the respective magnet.

In various embodiments, a combination of the respective magnetic forces of each respective magnet secures a nut situated within the third open jawed wrench.

In some embodiments, magnetic force emanating alone or in combination from the at least two magnets causes a nut situated within the third open jawed wrench and on a threaded rod to be held in place relative to the threaded rod and to the device when pulled by a force due to Earth gravity.

In other embodiments, the magnets are of a strength such that the device remains connected to and partially encircling the nut situated within the third open jawed wrench and on the threaded rod when a force from a normal adult human arm shifts the device around the nut without removing said device from said nut. When a force from a normal adult human arm shifts the device around the nut situated within the third open jawed wrench and on the threaded rod without removing the device from the nut, in embodiments, the magnetic force pulls the nut such that a midpoint of any substantially unbroken side of the nut is held against a midpoint of a respective side of the plurality of sides of the third open jawed wrench socket.

An open side of the first open-socket wrench and an open side of the second open-socket wrench are, in some embodiments, open at an acute angle relative to a most elongated plane of the wrench combination device. The first and the second open jawed wrench sockets, in various embodiments of the disclosed technology, are substantially equidistant from a center of the device, substantially equi-weighted, and substantially equi-sized.

A method of using the above-disclosed wrench combination device, in embodiments of the disclosed technology, has several steps carried out in any logical order. These include the steps of connecting the third open-jawed wrench socket to a nut on a threaded rod, spinning the device around the threaded rod such that the device moves the nut upwards and/or downwards relative to a most-elongated length of the threaded rod, and pushing the device upward and/or pulling the device downward relative to the most-elongated length of the threaded rod such that the device is removed from the nut on the threaded pole.

"Upwards" and "downwards" are defined relative to the most-elongated length of the threaded rod, such that one end of the most-elongated length of the threaded rod is designated "up" and an extreme opposite end of the most-elongated length of the threaded rod is designated "down".

The method may, in embodiments, have a further step of shifting the device in an upwards and/or downwards direction relative to the most-elongated length of the threaded rod such that the device is partially removed, and is not disconnected from, the nut on the threaded pole. The method may, in other embodiments, have an additional step of releasing the device which has been shifted upwards and/or downwards relative to the most-elongated length of the threaded rod, such that the device pulls the nut on the threaded rod such that a midpoint of any substantially unbroken side of the nut is held against a midpoint of a respective side of the plurality of sides of the third open jawed wrench socket.

Any device or step to a method described in this disclosure can comprise or consist of that which it is a part of, or the parts which make up the device or step. The term "and/or" is inclusive of the items which it joins linguistically and each item by itself.

DETAILED DESCRIPTION OF EMBODIMENTS OF THE DISCLOSED TECHNOLOGY

A wrench combination device including three open jawed wrench sockets is disclosed herein. A first open-jawed wrench socket is at one end of the device, and a second open-jawed wrench socket, which is substantially identical to the first, is at an extreme opposite end. A third open-jawed wrench socket is centered between and is inline with the first and second open jawed wrench sockets, and has two portals. The first portal is open at two opposite ends and extends normal to a plane passing through the first and second open jawed wrench sockets. The second portal opens on one side of the third socket and extends in the plane passing through the first and second open jawed wrench sockets.

Embodiments of the disclosed technology will become more clear in view of the following discussion of the figures.

Figure 1:
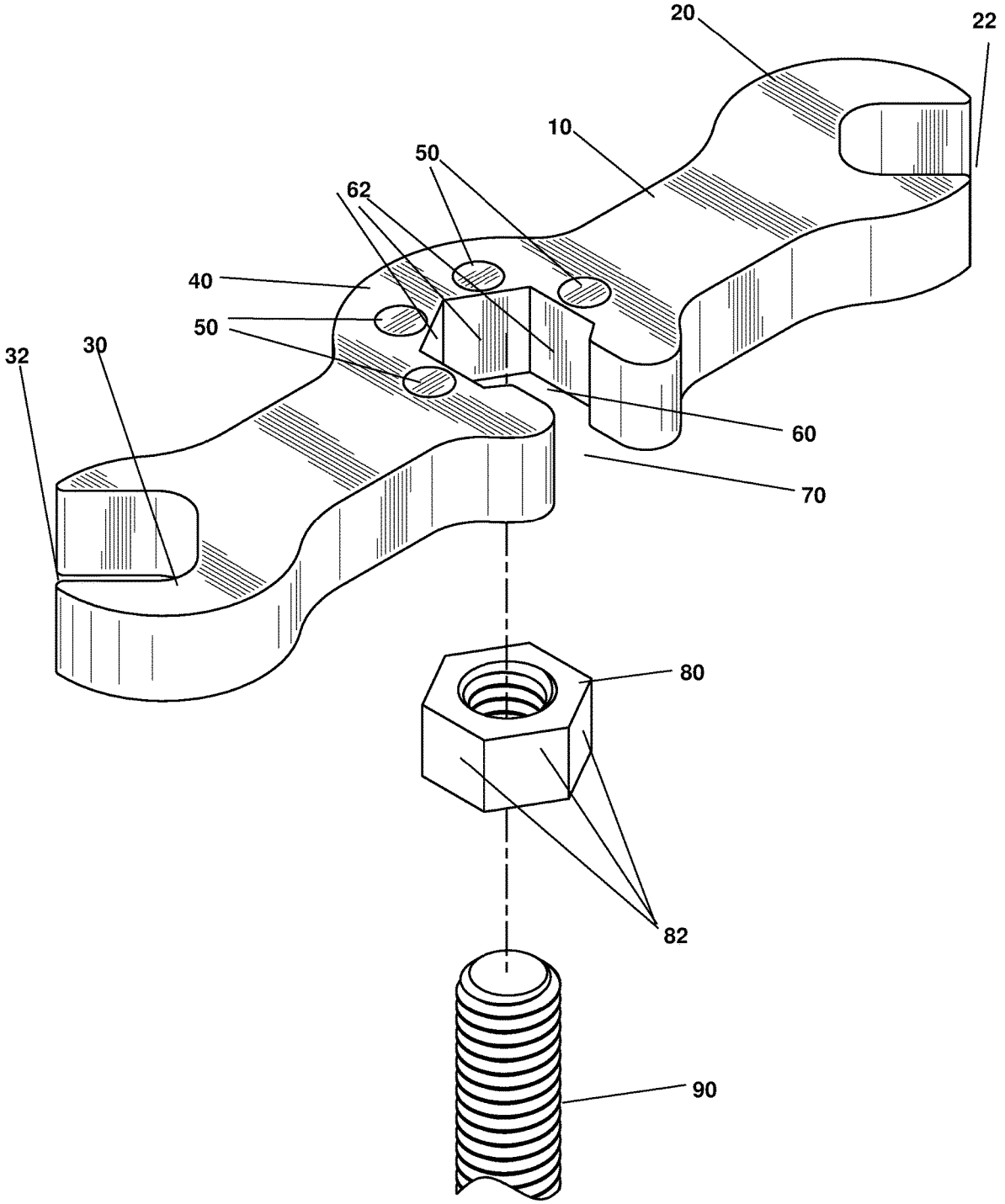
FIG. 1 shows a top and right perspective view of a wrench combination device, hex nut, and threaded rod of embodiments of the disclosed technology.
Figure 3:
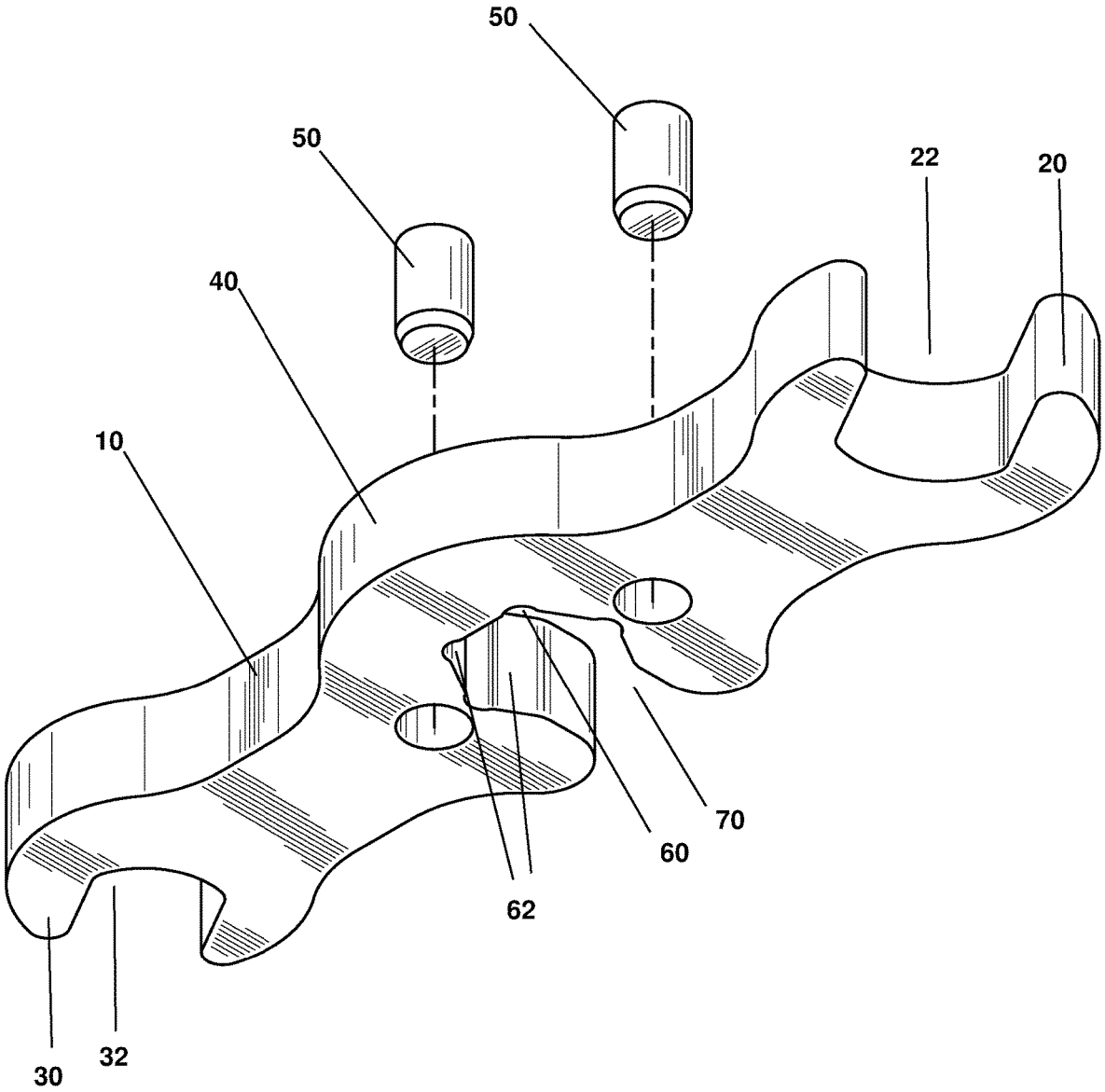
FIG. 3 shows a bottom and right perspective view of the wrench combination device.

Now discussing FIGS. 1 and 3 simultaneously: FIG. 1 shows a top and right perspective view of a wrench combination device, hex nut, and threaded rod of embodiments of the disclosed technology. FIG. 3 shows a bottom and right perspective view of the wrench combination device. The wrench combination device 10 has a first open-socket wrench 20 at a first end, with an opening 22 therein. The device 10 further has a second open-socket wrench 30 at an opposite end, with an opening 32 therein.

Disposed between, inline with, and equidistant from the first wrench 20 and the second wrench 30 is a third open-socket wrench 40. The third wrench 40 has a first portal 60 extending there-through in a direction normal to a plane passing through the first and the second open-jawed wrench sockets 20, 30. The third wrench 40 further has a second portal 70 which is open on a single side of the third wrench socket 40, and which extends in a plane passing through the first and the second open jawed wrench sockets 20, 30.

Enclosing the first portal 60 on a majority of sides is a plurality of sides 62. In various embodiments, each side 62 of the plurality of sides is substantially identical and/or is substantially flat. Each side 62 is connected to at least one adjacent side 62 at a substantially obtuse angle. In some embodiments, each substantially obtuse angle is substantially identical to each other substantially obtuse angle between a side 62 and an adjacent side 62.

In various embodiments, the second portal 70 has a length, in a plane parallel to a top side of the wrench device, which is equal to a length in the same plane of a side 62. In various other embodiments, the length in the same plane of the second portal 70 is greater than or less than a length in the same plane of a side 62.

In various embodiments, two magnets 50 are deposited within the third open-socket wrench 40 and are adjacent to at least one side 62 and/or to at least one convergence point of two sides 62, 62. The magnets 50 are visible on a top side and on a bottom side of the wrench combination device 10. The magnets 50, in other embodiments, may be visible on only the top side, on only the bottom side, or on neither the top nor the bottom side. In embodiments, every parallel horizontal plane passing through the plurality of sides 62 passes through the magnets 50. In some embodiments, each magnet 50 of the may be at least two magnets and/or more magnets 50 may be inserted within the third open-socket wrench 40. The magnets 50 may be arranged in an equi-spaced formation around the plurality of sides 62. The magnets 50 may be made of any magnetic and/or ferromagnetic material.

Each magnet 50, in some embodiments, applies a strongest magnetic force on a most adjacent side 62 and/or on a most adjacent convergence point of two sides 62 and/or on two or more most adjacent sides 62 relative to each respective magnet 50. The magnetic force applied by each magnet 50 is, in various embodiments, substantially identical.

In the embodiment shown, a first end of each of the magnets 50 has a circumference which is smaller than that of a second end of each of the magnets 50. In various embodiments, both the first ends and the second ends of the magnets 50 are substantially identical in shape and size. In some embodiments, the magnets 50 have a substantially uniform shape and size at every horizontal cross-section (i.e. at every cross-section which lies in a plane parallel to a top and/or bottom side of the wrench combination device).

The combination of magnetic forces applied by each respective magnet 50 may be sufficient to secure a nut 80 situated within the third open-jawed wrench 40. In some embodiments, the magnetic force emanating alone or in combination from the magnets 50 may cause a nut 80 situated within the third open-jawed wrench 40 and on a threaded rod 90 to be held in place relative to the threaded rod 90 and to the device 10 when pulled by a force due to Earth gravity.

Figure 2:
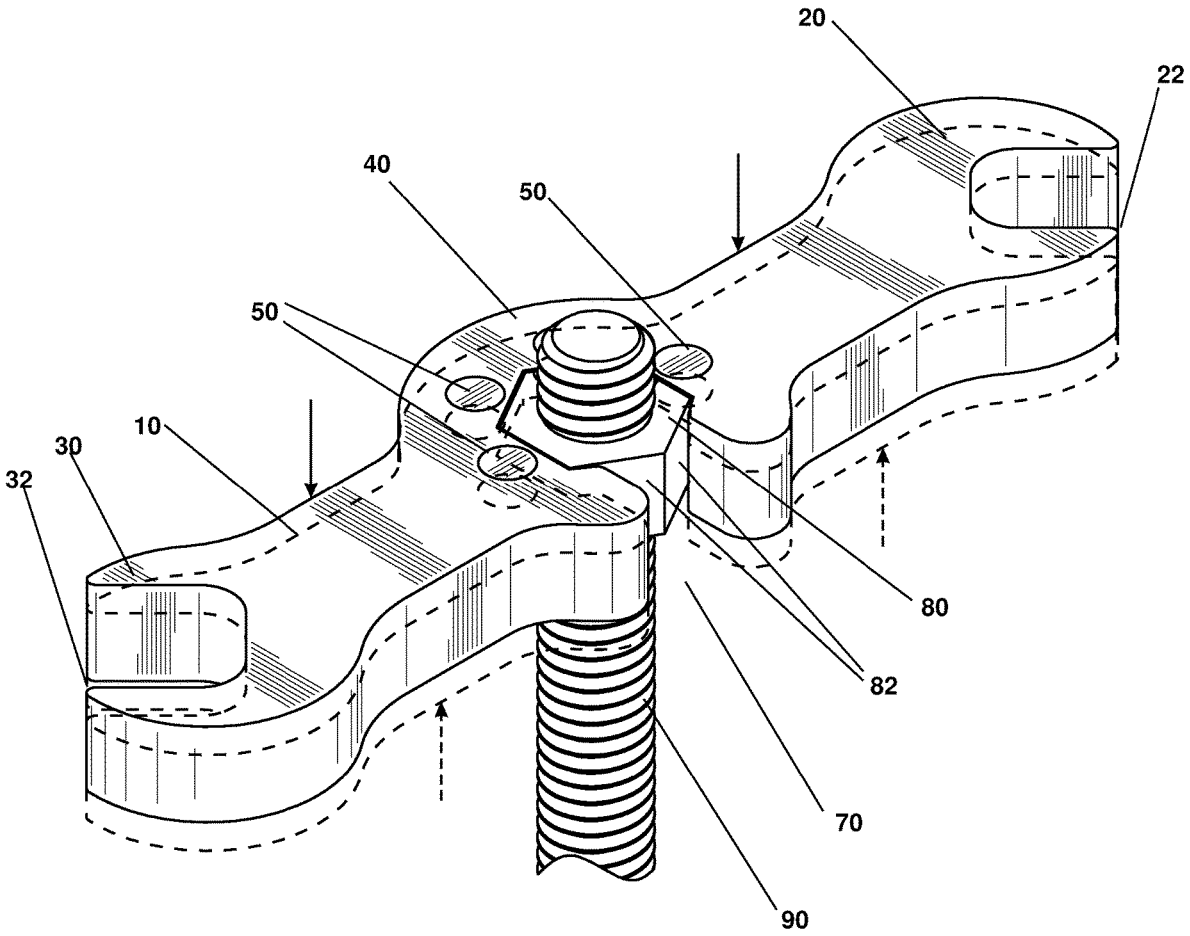
FIG. 2 shows the wrench combination device with the hex nut and threaded rod inserted therein.

FIG. 2 shows the wrench combination device with the hex nut and threaded rod inserted therein. The first wrench socket 20 and the second wrench socket 30 may be equi-weighted, and/or the two opposite ends of the device 10 may be equi-weighted, such that, when a nut 80 which is magnetically held within the first portal 60 is threaded onto a threaded rod 90, the device 10 may be rotated about the threaded rod 90 such that the nut is caused to travel upwards and/or downwards relative to a most-elongated length of the threaded rod 90.

In various embodiments, the magnetic force of the magnets 50 may have a strength such that the device 10 remains connected to and partially encircling the nut 80 situated within the third open jawed wrench 40 and on the threaded rod 90 when a causal force from a normal adult human hand shifts the device 10 around the nut 80 without removing the device 10 from the nut 80. Furthermore, the magnetic force of the magnets 50 may be of a strength such that, when a force from a normal adult human hand shifts the device 10 around the nut 80 situated within the third open jawed wrench 40 and on the threaded rod 90 without removing the device 10 from nut 80, the magnetic force pulls the nut 80 such that a midpoint of any substantially unbroken side 82 of the nut 80 is held against a midpoint of a respective side 62 of the third open jawed wrench socket 40. The magnetic force of the magnets 50 may have a strength such that, while the device 10 is placed around the nut 80 situated on the threaded rod 90, force from a normal adult human arm is sufficient to push and/or pull the device 10 away from the nut 80. Additionally, the device 10, when placed around a nut 80 which is threaded onto a threaded rod 90, may be held in a stationary position relative to the threaded rod 90 by frictional and/or magnetic force unless acted upon by other outside forces.

The magnets 50 are arranged in a same direction with respect to polarity, i.e. with a respective north side of each magnet 50 facing in a first direction and with a respective north side of each magnet 50 facing in a second and substantially opposite direction. In other embodiments, all magnets 50 may be arranged with a respective north side of each magnet 50 facing towards or away from the third open-jawed wrench socket 40 and with a respective south side of each magnet 50 facing, respectively, away from or towards the third open jawed wrench socket 40. Furthermore, all magnets 50 may be arranged to be facing a same direction within a longest plane of the device 10.

In some embodiments, one of the above arrangements may be required for the maintenance of the position of the device 10 relative to the threaded rod 90 when placed around a nut 80 which is threaded onto the threaded rod 90. In various embodiments, a device 10 lacking one of these arrangements may move downward relative to the threaded rod 90 when placed around a nut 80 which is threaded onto the threaded rod 90.

Figure 4:
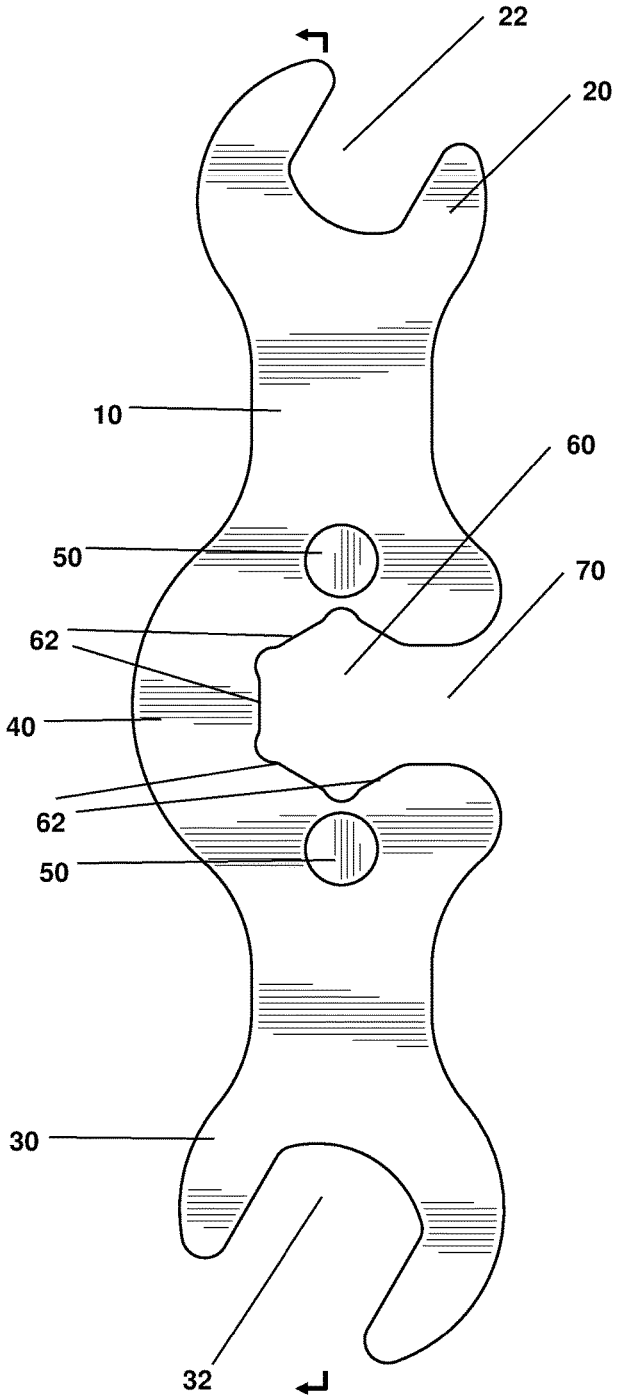
FIG. 4 shows a top plan view of the wrench combination device.
Figure 6:
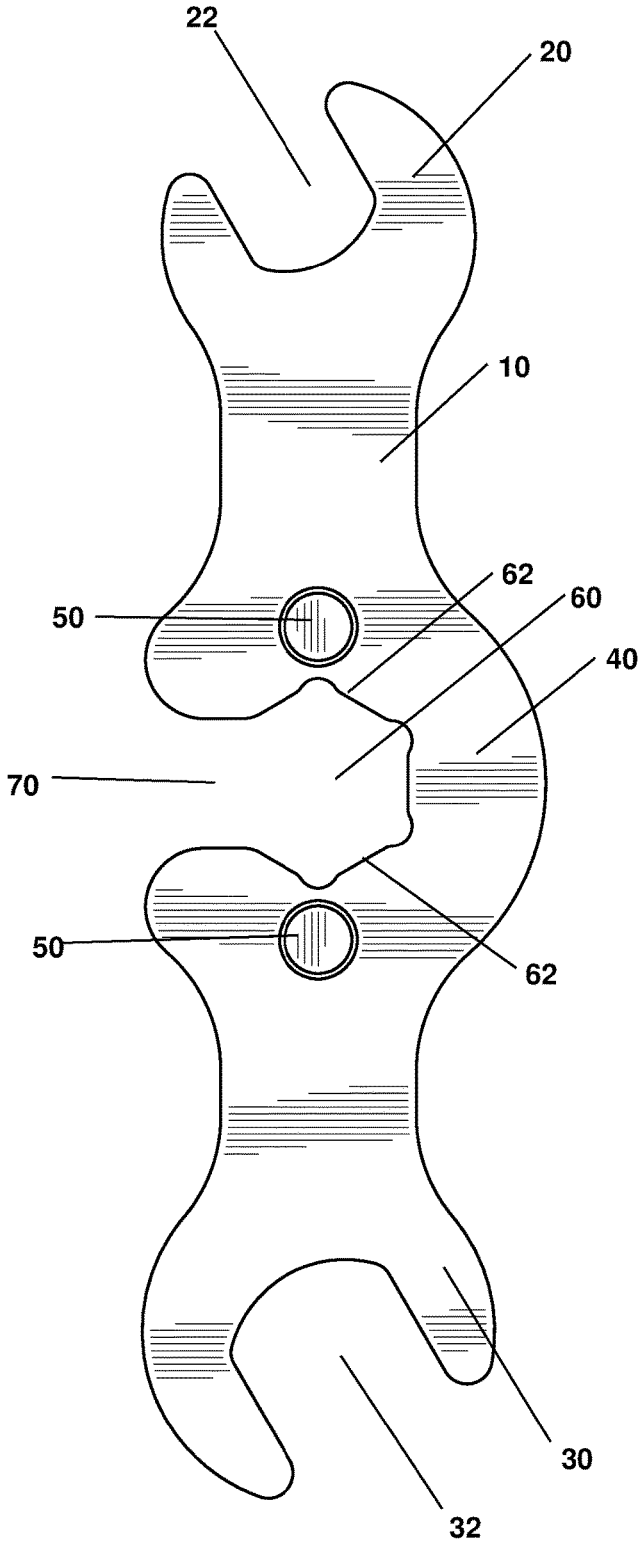
FIG. 6 shows a bottom plan view of the wrench combination device of FIG. 4.

FIG. 4 shows a top plan view of the wrench combination device of FIG. 1. FIG. 6 shows a bottom plan view of the wrench combination device of FIG. 1. As shown by these figures, the first open jawed wrench socket 20 and the second open jawed wrench socket 30 are substantially identical in the embodiment shown. In various embodiments, the first and second wrenches 20, 30 may be different in size and/or shape. In other embodiments, at least one of the first wrench 20 and/or the second wrench 30 may be an adjustable wrench, an allen wrench, a lug wrench, and/or any other form of wrench such as one which forms a closed loop with portal passing there-through.

The first and second wrench sockets 20, 30 may be situated such that the openings therein 22, 32 face substantially opposite parallel sides of the device 10. In other embodiments, both openings 22, 32 may face a same side of the device 10, and may face away from a plane normal to the top side of the device 10 by a same number of degrees.

The magnets 50, in various embodiments, may lie such that a flat end of each magnet 50 is in a same plane as a same side of the wrench device 10. In other embodiments, at least a part of an end of each magnet 50 may jut past a same plane as a same side of the wrench device 10, or may lie within a recess in which the respective magnet 50 is disposed. In other embodiments, the magnets 50 may be covered on one or both ends.

Figure 5:
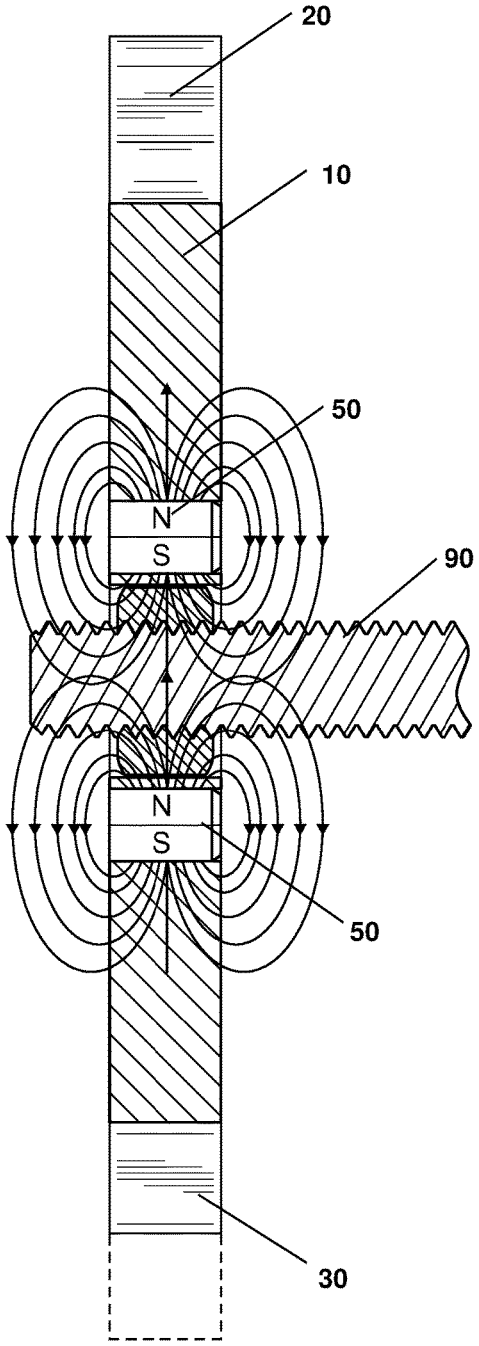
FIG. 5 shows a right side cutaway elevation view along section line 4-4 of FIG. 4 with hex nut and threaded rod.
Figure 7:
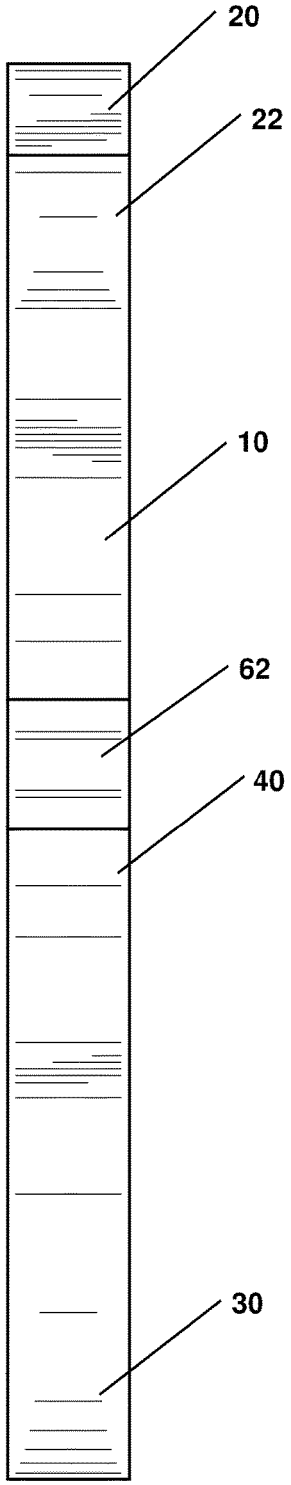
FIG. 7 shows a right side elevation view of the wrench combination device of FIG. 4.
Figure 8:
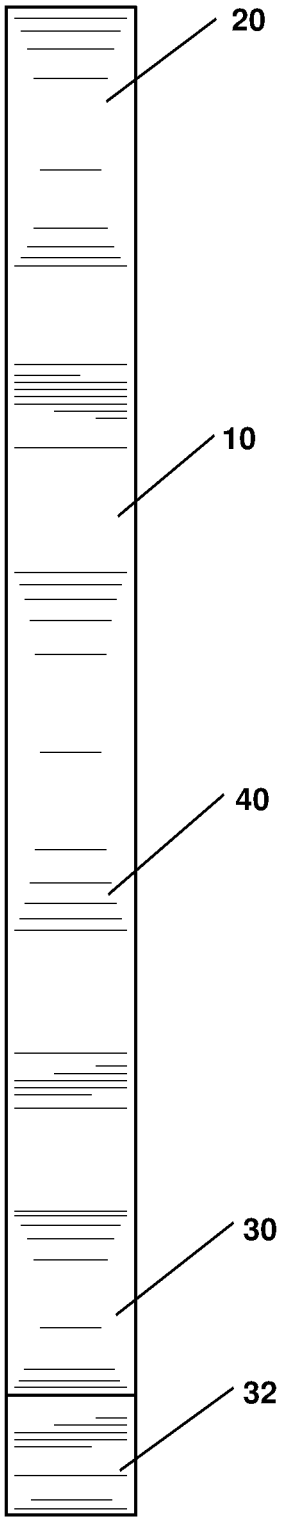
FIG. 8 shows a left side elevation view of the wrench combination device of FIG. 4.
Figure 9:
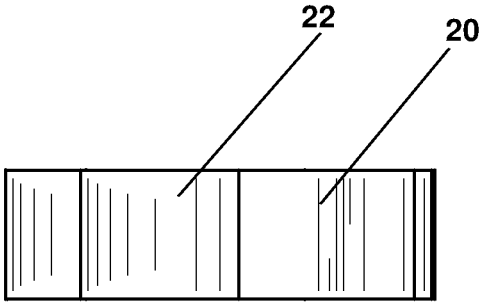
FIG. 9 shows a front elevation view of the wrench combination device of FIG. 4.
Figure 10:
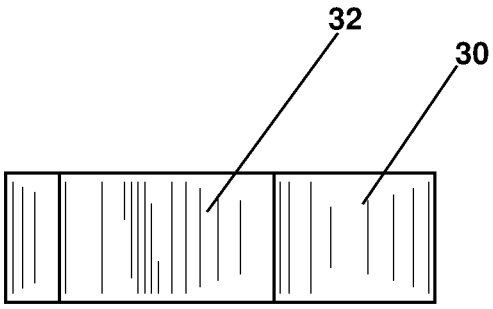
FIG. 10 shows a back elevation view of the wrench combination device of FIG. 4.

FIG. 5 shows a right side cutaway elevation view along section line 4-4 of FIG. 4 with hex nut and threaded rod. FIG. 7 shows a right side elevation view of the wrench combination device of FIG. 4. FIG. 8 shows a left side elevation view of the wrench combination device of FIG. 4. FIG. 9 shows a front elevation view of the wrench combination device of FIG. 4. FIG. 10 shows a back elevation view of the wrench combination device of FIG. 4. As shown by these figures, a vertical height of the device 10 may be substantially greater than and/or substantially equal to and/or substantially smaller than a vertical height of the nut 80. The vertical height of the device 10 may furthermore be substantially uniform throughout, or may become greater and/or smaller in at least one section of the device 10.

For purposes of this disclosure, the term "substantially" is defined as "at least 95% of" the term which it modifies.

Any device or aspect of the technology can "comprise" or "consist of" the item it modifies, whether explicitly written as such or otherwise.

When the term "or" is used, it creates a group which has within either term being connected by the conjunction as well as both terms being connected by the conjunction.

While the disclosed technology has been disclosed with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A wrench combination device comprising:

a first open-jawed wrench socket at a first end of said device;

a second wrench socket disposed at a second end of said device, said second end being at an extreme opposite end relative to said first end;

a third open-jawed wrench socket centered between and inline with said first and said second open-jawed wrench sockets, said third open-jawed wrench socket comprising two portals:

a first portal open at two opposite ends which extends normal to a plane passing through said first and said second open-jawed wrench sockets; and a second portal open on a single side of said third open-jawed wrench socket extending in said plane passing through said first and said second open-jawed wrench sockets, wherein said first portal of said third open-jawed wrench socket is enclosed on a majority of sides, wherein each side of said majority of sides is substantially flat and has an equal non-right angle to at least one adjacent side of said majority of sides, and said second portal has a length equal to each side of said majority of sides of said third open-jawed wrench socket.

2. A wrench combination device comprising:

a first-jawed wrench socket at a first end of said device;

a second wrench socket disposed at a second end of said device, said second end being at an extreme opposite end relative to said first end;

a third opened-jawed wrench socket centered between and inline with said first and said second open-jawed wrench sockets, said third open-jawed wrench socket comprising two portals:

a first portal open at two opposite ends which extends normal to a plane passing through said first and said second open-jawed wrench sockets; and a second portal open on a single side of said third open-jawed wrench socket extending in said plane passing through said first and said second open-jawed wrench sockets, wherein said first portal of said third open-jawed wrench socket is enclosed on a majority of sides, wherein a shape formed by a combination of said second portal and said majority of sides of said third open-jawed wrench socket forms a regular polygon shape, wherein each side of said majority of sides of said third open-jawed wrench socket has embedded therein a magnet, wherein every horizontally-oriented plane passing through one magnet of said magnets also passes through each other magnet of said magnets, wherein each said magnet, excepting for those closest to a spaced apart region, is at a substantially identical angle to each adjacent magnet, wherein each said magnet applies a strongest magnetic force on a most adjacent side relative to said magnet.

3. The wrench combination of claim 2, wherein each side of said majority of sides of said third open-jawed wrench socket has a substantially identical magnetic force applied thereto by each said respective magnet.

4. A wrench combination device comprising:

a first open-jawed wrench socket at a first end of said device;

a second wrench socket disposed at a second end of said device, said second end being at an extreme opposite end relative to said first end;

a third open-jawed wrench socket centered between and inline with said first and said second open-jawed wrench sockets, said third open-jawed wrench socket comprising two portals:

a first portal open at two opposite ends which extends normal to a plane passing through said first and said second open-jawed wrench sockets; and a second portal open on a single side of said third open-jawed wrench socket extending in said plane passing through said first and said second open-jawed wrench sockets, wherein said first portal of said third open-jawed wrench socket is enclosed on a majority of sides, wherein a shape formed by a combination of said second portal and said majority of sides of said third open-jawed wrench socket forms a regular polygon shape, wherein each side of said majority of sides of said third open-jawed wrench socket has embedded therein a magnet, wherein every horizontally-oriented plane passing through one magnet of said magnets also passes through each other magnet of said magnets, wherein each said magnet, excepting for those closest to a spaced apart region, is at a substantially identical angle to each adjacent magnet, wherein a combination of said respective magnetic forces of each said respective magnet secures a nut situated within said third-open jawed wrench, wherein magnetic force emanating alone or in combination from said magnets causes a nut situated within said third open-jawed wrench and on a threaded rod to be held in place relative to said threaded rod and to said device when pulled by a force due to Earth gravity.

5. The wrench combination device of claim 4, wherein said magnets are of a strength such that said device remains connected to and partially encircling said nut situated within said third open-jawed wrench and on said threaded rod when a force from a normal adult human arm shifts said device around said nut without removing said device from said nut.

6. The wrench combination device of claim 5, wherein said magnets are of a strength such that, when a force from a normal adult human arm shifts said device around said nut situated within said third open-jawed wrench and on said threaded rod without removing said device from said nut, said magnetic force pulls said nut such that a midpoint of any substantially unbroken side of said nut is held against a midpoint of a respective side of said majority of sides of said third open jawed wrench socket.

* * * * *